US010738943B2

(12) United States Patent
Tilhof

(10) Patent No.: US 10,738,943 B2
(45) Date of Patent: Aug. 11, 2020

(54) FILLING STATION FOR GAS BOTTLES AND FILLING METHOD

(71) Applicant: LPG suisse AG, Wangen (CH)

(72) Inventor: Eckhard Tilhof, Altendorf (CH)

(73) Assignee: CleanTech Swiss AG, Wangen (CH)

( * ) Notice: Subject to any disclaimer, the term of this patent is extended or adjusted under 35 U.S.C. 154(b) by 256 days.

(21) Appl. No.: 15/526,551

(22) PCT Filed: Oct. 28, 2015

(86) PCT No.: PCT/EP2015/074952
§ 371 (c)(1),
(2) Date: May 12, 2017

(87) PCT Pub. No.: WO2016/074924
PCT Pub. Date: May 19, 2016

(65) Prior Publication Data

US 2017/0314733 A1 Nov. 2, 2017

(30) Foreign Application Priority Data

Nov. 12, 2014 (EP) ..... 14192881

(51) Int. Cl.
*F17C 5/00* (2006.01)
*F17C 13/02* (2006.01)

(52) U.S. Cl.
CPC ..... *F17C 5/005* (2013.01); *F17C 13/02* (2013.01); *F17C 2201/054* (2013.01);
(Continued)

(58) Field of Classification Search
CPC . F17C 5/06; F17C 5/002; B65B 31/00; B65B 31/04
(Continued)

(56) References Cited

U.S. PATENT DOCUMENTS 2,792,854 A * 5/1957 De Groat ..... H01J 9/38 141/65
4,567,923 A * 2/1986 Nalbach ..... F17C 5/005 141/82
(Continued)

FOREIGN PATENT DOCUMENTS

CN 1676392 A 10/2005
CN 103328876 A 9/2013
(Continued)

OTHER PUBLICATIONS

International Search Report and Written Opinion for corresponding Patent Application No. PCT/EP2015/074952 dated Feb. 29, 2016.
(Continued)

*Primary Examiner* — Timothy L Maust
(74) *Attorney, Agent, or Firm* — Renner, Otto, Boisselle & Sklar, LLP

(57) ABSTRACT

The filling station according to the invention enables an automated refilling of a gas bottle by an end-user. This comprises an insertion device, which enables an end-user to insert an emptied gas bottle into the filling station. The filling station comprises a closing device for closing the filling station after the insertion of the gas bottle such that a removal of the gas bottle subsequent to the closing is not possible. The end-user may not remove the gas bottle in a closed state. Furthermore, the filling station comprises a filling device for an automated filling of an into the filling station inserted emptied gas bottle subsequent to the closing. A filling may thus only take place, if the filling station is closed and in consequence the gas bottle cannot be removed. There is a gas testing device for an automated gas leakage test after a refilling of an inserted gas bottle. With it, the tightness of a once again filled gas bottle is tested. There is a release device that releases an afore filled or full gas bottle only after a successful gas leakage test and thus enables a
(Continued)

Figure 1:
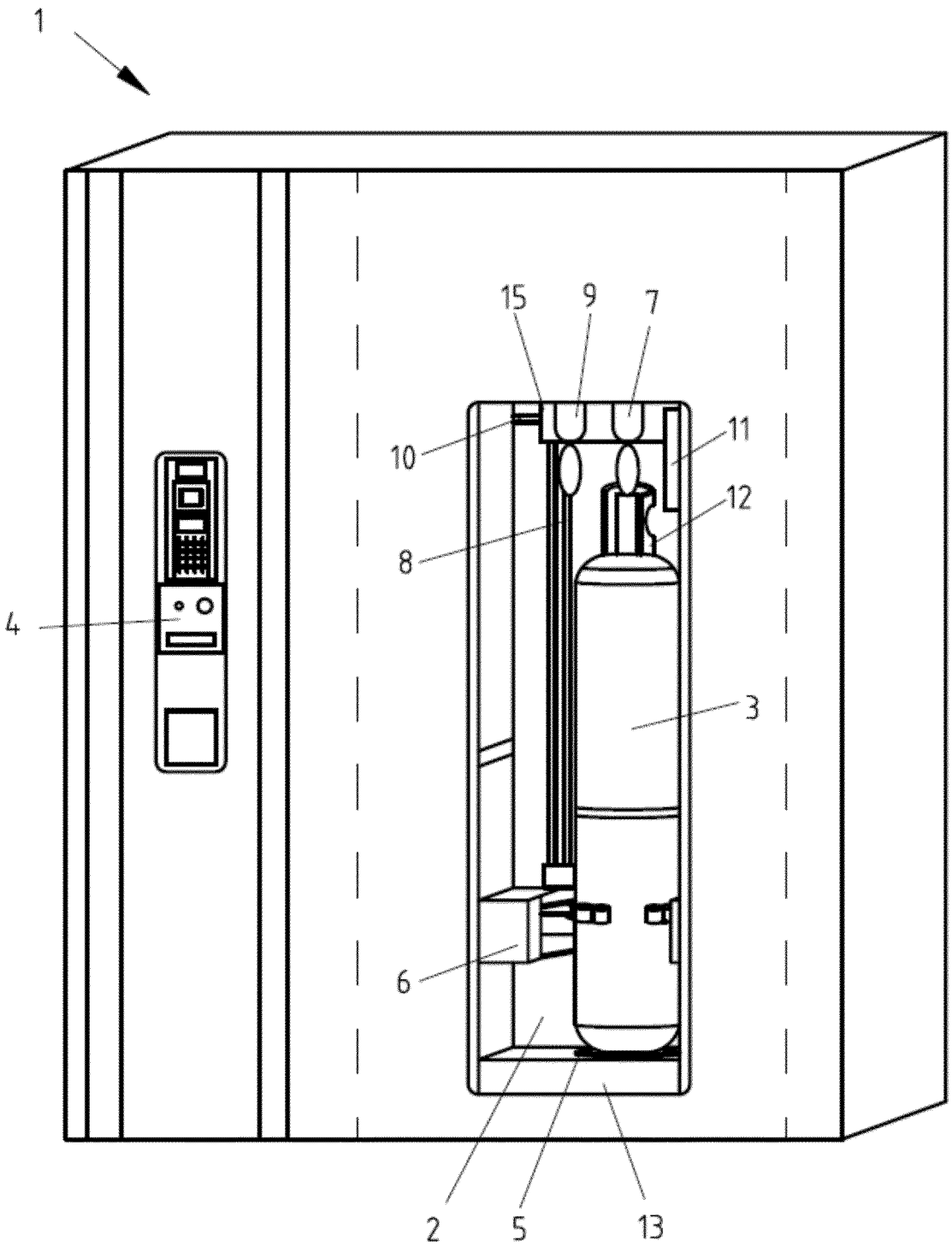

removal of a once again filled gas bottle. A removal of a gas bottled filled with gas respectively liquid gas is thus only possible, if the gas leakage test revealed that no gas escapes from the filled bottle. The invention further concerns a method for refilling.

21 Claims, 4 Drawing Sheets

(52) U.S. Cl.
CPC .. *F17C 2201/056* (2013.01); *F17C 2201/058* (2013.01); *F17C 2203/0639* (2013.01); *F17C 2203/0646* (2013.01); *F17C 2205/0107* (2013.01); *F17C 2205/0111* (2013.01); *F17C 2205/0153* (2013.01); *F17C 2205/0157* (2013.01); *F17C 2205/05* (2013.01); *F17C 2221/035* (2013.01); *F17C 2223/0153* (2013.01); *F17C 2223/033* (2013.01); *F17C 2225/0153* (2013.01); *F17C 2250/03* (2013.01); *F17C 2250/032* (2013.01); *F17C 2250/0421* (2013.01); *F17C 2250/0443* (2013.01); *F17C 2250/07* (2013.01); *F17C 2270/0139* (2013.01); *F17C 2270/0171* (2013.01); *F17C 2270/059* (2013.01); *F17C 2270/0709* (2013.01); *F17C 2270/0745* (2013.01)

(58) Field of Classification Search
USPC ..... 141/3, 66, 83
See application file for complete search history.

(56) References Cited

U.S. PATENT DOCUMENTS

| | | | | | |
|---|---|---|---|---|---|
| 4,657,055 | A * | 4/1987 | Poulsen | F17C 5/005 | 141/83 |
| 4,856,565 | A * | 8/1989 | Schoeffl | F17C 13/084 | 141/97 |
| 5,513,678 | A * | 5/1996 | Schultz | F17C 5/06 | 141/198 |
| 5,913,344 | A * | 6/1999 | Wronski | F17C 5/005 | 141/4 |
| 5,953,682 | A * | 9/1999 | McCarrick | F17C 13/003 | 702/45 |
| 6,904,913 | B2 * | 6/2005 | Aylsworth | A61M 16/10 | 128/204.22 |
| 7,249,617 | B2 * | 7/2007 | Musselman | G05D 16/2046 | 128/200.24 |
| 7,752,892 | B2 * | 7/2010 | Muller | G01M 3/229 | 73/49.2 |
| 9,139,313 | B2 * | 9/2015 | Camilotti | F17C 6/00 | |
| 9,310,024 | B2 * | 4/2016 | Plummer | F17C 13/003 | |
| 9,689,532 | B2 * | 6/2017 | Barbato | F17C 5/06 | |
| 9,765,932 | B2 * | 9/2017 | Rado | F17C 5/06 | |
| 2003/0010395 | A1 | 1/2003 | Sakamoto et al. | | |
| 2011/0186173 | A1 | 8/2011 | Suero Castaño et al. | | |
| 2013/0112194 | A1 * | 5/2013 | Berry | A61K 9/008 | 128/200.23 |
| 2013/0153084 | A1 | 6/2013 | Camilotti et al. | | |
| 2015/0153003 | A1 * | 6/2015 | Miller | C01B 21/24 | 141/8 |

FOREIGN PATENT DOCUMENTS

| | | | | |
|---|---|---|---|---|
| EP | 2 169 294 | A1 | 3/2010 | |
| ES | 2 423 107 | A1 | 9/2013 | |
| FR | 2 618 875 | A1 | 2/1989 | |
| FR | 2618875 | A1 * | 2/1989 | F17C 5/005 |
| JP | S63-249033 | A | 10/1988 | |
| JP | H08-170797 | A | 7/1996 | |
| JP | H10-061892 | A | 3/1998 | |
| JP | 2002-181299 | A | 6/2002 | |
| JP | 2003-014193 | A | 1/2003 | |
| JP | 2006-283899 | A | 10/2006 | |
| JP | 2008-105699 | A | 5/2008 | |
| JP | 2013-537606 | A | 10/2013 | |
| WO | 2010/030921 | A1 | 3/2010 | |
| WO | 2012/071593 | A2 | 5/2012 | |
| WO | 2013/121067 | A1 | 8/2013 | |
| WO | 2014/053748 | A1 | 4/2014 | |
| WO | 2014/159516 | A1 | 10/2014 | |

OTHER PUBLICATIONS

Translation of Japanese Office Action for corresponding Japanese Patent Application No. 2017-525520 dated Oct. 1, 2019.

* cited by examiner

FILLING STATION FOR GAS BOTTLES AND FILLING METHOD

The invention concerns a filling station for gas bottles, in particular liquid gas bottles. The invention furthermore concerns a method for refilling of gas bottles.

A filling station for gas bottles is known from the document DE 32 14 629 A1, EP 2 169 294 A1 as well as from the document WO 2013/121067 A1. The document US 2013/0153084 A1 discloses an automated filling station for gas bottles, which shall be set up in retail shops. Gas filling systems with a test device are known from the documents FR 2 618 875 A1 and WO 2014/030921 A1.

A gas bottle is a pressure container commonly consisting of metal, usually of steel, for the transportation and storage of gases being under pressure. A gas bottle may also consist of aluminum or composite materials. Such a bottle may have a volume of more than 100 liters. The nominal pressure may amount to several hundred bars.

In liquid gas bottles, there are gases like for example LPG in liquefied state. Common gases are ethane, propane, butane as well as mixtures thereof. The gases can be liquefied at room temperature by comparatively low pressure. Liquid gas bottles are closed with a fitting, which allows, often in conjunction with a pressure reducer, a suitable hosepipe for controlled withdrawal of its contents to be screwed on. Moreover, at liquid gas bottles, a safety valve is arranged in the withdrawal fitting, which limits the allowable overpressure in the bottle to for example ca. 30 bars in order to prevent bursting.

Typically, a fitting of such liquid gas bottle has a connection piece (nozzle) at the side, which on the one hand is used for the filling and on the other hand for the withdrawal. At this sideward connection piece, lines are manually screwed on to in both cases the withdrawal as well as a refilling.

Liquid gas bottles are used for the operating gas stoves, gas cookers, gas barbecues, gas heaters or gas radiant heaters. When the content of a liquid gas bottle is used up, liquid gas bottles are returned by the user to the point of sale for the purpose of renewed refilling. After such a return of a liquid gas bottle, it is transported from the point of sale to a central filling system respectively filling station.

In order to make a refilling easier, it is known from the document DE 43 34 182 A1 to provide a centric filling point in addition to a connection piece at the side. A filling may then be carried out from above without necessity of alignment of a sideward protruding connecting piece.

It is object of the invention to reduce the technical expenditure for refilling of gas bottles.

The problem of the invention is solved by a filling station with the features of the main claim as well as by a method with the features of the independent claim. Advantageous embodiments result from the dependent claims.

The claimed filling station enables an automated filling of a gas bottle by an end-user. It comprises an insertion device, which allows the end-user to insert an emptied gas bottle into the filling station. The filling station comprises a closing device for closing the filling station after the insertion of the gas bottle such that a removal of the gas bottle is not possible after the closing. The end-user cannot remove the gas bottle in the closed state. The filling station further comprises a filling device for an automated filling, after the closing, of an emptied gas bottle that has been inserted into the filling station. Filling may therefore only take place, when the filling station is closed and the gas bottle thus cannot be removed. There is a gas testing device for an automated gas leakage test subsequent to a refilling of an inserted gas bottle. With it, the tightness of a once again filled gas bottle is tested. There is a release device that releases an afore filled or full gas bottle only after a successful gas leakage test and thus enables a removal of a once again filled gas bottle. A removal of a gas bottled filled with gas respectively liquid gas is thus only possible, if the gas leakage test revealed that no gas escapes from the filled bottle.

The filling station is thus designed such that an end-user can fill a gas bottle, which was used by him, once again with gas without having to return a gas bottle to an appropriate return point like for example a point of sale. A common further transport from a return point to a central filling system is thereby omitted. This allows to reduce the transportation expenditures and the related personnel expenses. A user can get back a once again filled bottle independent from business opening hours.

Because a user only gets back a filled bottle, if it is also really gas tight, there is no risk that a defect of a gas bottle remains unnoticed and therewith that there are increased safety risks for an end-user.

In one embodiment, a gas leakage test is also taking place before a refilling. If this gas leakage test reveals that an inserted, largely emptied gas bottle is already untight, then it is not once again filled. Preferably, the remaining content is emptied instead and the thus completely emptied bottle is released to the user.

Transportation expenditure can be reduced in a further improved manner by setting up claimed filling stations at place where gas bottles are commonly used or to which liquid gas is usually transported to. Preferably, for example camping grounds and/or service stations (petrol/fuelling station) are therefore equipped with the claimed filling stations. A thereby achieved further reduction of the transportation expenditure contributes further improved, among others, environmental protection.

In one embodiment, the filling station comprises an identification device, by which a gas bottle can be identified. This allows to determining, whether a gas bottle is suitable for an automated filling. By means of a corresponding control unit, the filling can be controlled depending on the result of an identification. Thus, filling is only carried out, if it was afore determined by the identification device, that the used gas bottle is suitable. The identification further allows to determining the volume and the size the used gas bottle. Herewith, the refilling can be controlled and accelerated. Deviations from the expected result, for example concerning the filling quality, can be used to identify malfunctions. For example, the identification device allows to determining that a maximum of 5 kg of gas are permitted to be filled into an inserted gas bottle. By measuring the weight of the inserted and not yet once again filled gas bottle, the filling station determines that there is still a remaining gas quality of 1 kg in the gas bottle. The filling station may then be configured such that it is determined in an automated manner already before the start of the filling process that not more than 4 kg are to be filled into the gas bottle.

In order to reduce issues due to misuse and vandalism, the filling station is configured such that it is normally closed. In the closed state, no gas bottle can be inserted into the filling station and also no gas bottle can be removed from the filling station. When a gas bottle is to be inserted, it has firstly to be identified as suitable by the identification device. Only if this test reveals that a gas bottle is suitable, the filling station opens and enables an insertion of the gas bottle. An insertion of the gas bottle into the filling station is thus only possible after a successful identification test.

In one embodiment, alternatively or additionally, an identification of the inserted gas bottle by means of the identification device takes place, specifically preferably after closing the filling station. Thereby, a last monitoring is carried out whether really a suitable gas bottle has been inserted in order to avoid malfunctions in a further improved manner.

Preferably, the gas bottle in the inserted state is located in a completely closed room when the filling station is closed, in order to thereby shield an inserted gas bottle to the outside in a maximal possible way when it is once again filled. The safety is thus further improved.

In one embodiment, the filling station comprises a weighing machine, by which the weight of an inserted gas bottle can be determined before the refilling and/or after the refilling. By determining the weight of the gas bottle before the refilling, the filling station can determine how much gas can be filled into the bottle. By determining the weight of the gas bottle after the refilling, the filling station can monitor whether the gas bottle has been filled completely and properly. Deviations from the expected result indicate a malfunction and thereby contribute to the safety in an improved manner. By determining the weight of the gas bottle both before the refilling and after the refilling, it can determined how much gas has been filled into the bottle. This can be used to control the filling and/or to bill the user. Alternatively or additionally, a gas flow meter may be used to determine how much gas has been filled into the inserted gas bottle in order to for example bill the user or determine malfunctions.

In one embodiment of the invention, the filling station comprises an emptying device, by which an inserted gas bottle can be emptied (drained). By means of the emptying device, the content of an inserted gas bottle is emptied particularly in the case when a malfunction has been determined. If for example a gas leakage test reveals that the filled gas bottle is untight, the gas bottle is emptied by the emptying device. Risks are thereby further reduced.

In one embodiment, the emptying device comprises a preferably movable suction head. The suction head may allow to be preferably horizontally and/or vertically moved, in order to enable connecting it in a suitable manner to a fitting of a gas bottle. The suction head preferably has a valve opening device, in particular a pin (mandrel) or nozzle (spigot) protruding such that a respective valve of the gas bottle is opened with the valve opening device, i.e. in particular with the pin or nozzle, by connecting to the fitting, or respectively a valve body of the gas bottle is moved by the pin or nozzle against a spring force in such a manner that the respective valve is opened. Subsequent to the opening of the valve, sucking off and thus emptying of the gas bottle can be carried out. In the connected condition, the valve is permanently open.

In one embodiment, the release device releases the gas bottle after such emptying, so that the defect gas bottle can be removed by the user in a completely emptied condition. Preferably, there is a signaling device, which then displays the defect or the malfunction, respectively, to the user and informs him that the gas bottle may not be further used and/or should be handed over to a therefore provided return point.

Preferably, in addition to the suction head, there is a filling head, which does not have such protruding pin or nozzle that allow the above mentioned valve to be opened. Also in the connected condition between filling head and fitting, the respective valve of the gas bottle is then closed and is only opened once gas is pumped into the bottle and thereby the valve is opened. Hereby, safety risks are avoided, because the valve is only opened if needed.

The filling head is preferably also movable, specifically particularly horizontally and/or vertically, in order to allow to be suitable connected to the fitting.

In one embodiment, the suction head and/or the filling head comprise one or more grip (grasp) elements, which may catch the fitting of an inserted and centered gas bottle entirely or partly such that a positive connection (form-fit connection) between fitting and the suction head can thereby be obtained. This allows to ensuring in an improved way that the connection between a head and the fitting will not unintentionally detaches during the filling or during the emptying.

In order to keep the technical expenditure low, the filling head and suction head are in one embodiment mounted together on a movable slide. One slide suffices for both filling head and also suction head to enable to be moved together.

Preferably, a test head of the gas testing device is furthermore mounted at the slide, which thus may also be moved by the slide in order to thereby be able to conduct the gas leakage test in due time. Also this contributes to keep the technical expenditure low.

Preferably, there are one or more horizontally and/or vertically running rails that serve to enable horizontally and/or vertically drive respectively moving the slide.

The release device basically comprises a control, which controls the release. The control is configured such that only after a successful gas leakage test or after a complete emptying of a gas bottle, it is released for a removal.

In one embodiment, a gas bottle comprises a writable memory and the filling station a corresponding writing unit, by which a information may be stored in the memory. In case of a malfunction, it is then stored in the memory that the gas bottle is defect and thus is unsuitable for a refilling, in order to thereby avoid that this defect gas bottle is used once again in a filling station. Safety risks and malfunctions are thereby avoided in a further improved manner.

In one embodiment, the filling station comprises a centering device, by which an inserted gas bottle is centered and thus positioned for a refilling. This embodiment contributes to allow refilling of a gas bottle with low technical expenditure.

In one embodiment, the centering device comprises a centering gripper, which may encompass an inserted gas bottle with arms and thus allows centering. Preferably, at least one arm is motor-driven movable in order to center an inserted gas bottle by means of moving and thereby effected encompassing. Preferably, the centering gripper comprises one or more rolls, which allow lying against an inserted gas bottle or butt against in order to thereby further facilitate the centering. In one embodiment, one or more of the rolls are provided with one or more motorized drives in order to, in case of the presence of a gas bottle filling nozzle at the side, align said filling nozzle suitably for a refilling.

In one embodiment, the filling station comprises a turnable plate (disk), on which an inserted gas bottle is placed. The turnable plate or turntable, respectively, contributes in an improved manner to allow centering and/or aligning an inserted gas bottle reliably and fast. In one embodiment, the turnable plate may be rotated by a motorized drive in order to contribute to the centering and/or aligning by rotating the plate. It is also possible that the plate may be freely rotatable such that for example an alignment may be carried out by means of the above mentioned rolls.

In one embodiment, the filling station is arranged such that refilling of an inserted gas bottle is carried out from above via (through) a centric filling point of the gas bottle. An automated refilling can thereby be conducted at very low technical expenditure.

In one embodiment, the filling station comprises preferably at its bottom side one or more apertures, though which gas can be guided outward. Preferably, there are fans, by which gas may be pumped outward from the gas filling station though these apertures. In all, a risk of explosion can thereby be avoided.

In one embodiment of the invention, the filling station is arranged such that it may be already connected to an existing gas tank. This embodiment is especially suitable for setting up at service stations.

In one embodiment of the invention, the filling station comprise an own gas tank. This embodiment is suitable for setting up at camping grounds and the like.

In one embodiment, the filling station has the dimensions of a container with standard (normed) size, specifically preferably a 10-foot container, 20-foot container or 40-foot container. The transport of a filling station is thereby facilitated.

In one embodiment, the filling station has quick locks in order to fasten the filling station by means of the quick locks for example on a semi-trailer truck.

In one embodiment, the filling station preferably including an own gas tank is part of a semi-trailer truck, a trailer or a part of a truck in order to thereby create a mobile filling station. This allows fast reaction on the respective demand for example depending on the season to place filling stations for example only for a limited time at desired places such as for example a camping grounds.

In one embodiment of the invention, the filling station comprises a payment device, though which it can be paid for the refilling for example by EC card, credit card, in cash, by mobile phone and/or other electronical ways.

By means of the following embodiments, the devices of the filling station may allow to be realized in a technically simple manner.

The release device may comprise grip arms, which may encompass an inserted gas bottle such that it cannot be removed out of the filling station in the encompassed condition. It is also possible that the release device may alternatively or additionally control the opening of a door, which has to be opened for a removal of a gas bottle out of the filing station.

The gas testing device may comprise a test head with a gas sensor being located therein. The test head may preferably be put over the fitting of the gas bottle in such a way that an interior room is provided, in which the fitting of the gas bottle is located. The gas sensor may then detect the appearance of gas in this interior room. Hereby, gas untightness may be detected particularly fast and in a technically very simple manner.

The centering device may comprise a centering gripper with grip arms. By encompassing a gas bottle by means of the arms, the gas bottle can be centered. The arms can be provided with rolls in order to further facilitate the centering or positioning, respectively, of the inserted gas bottle. The centering device may comprise a turntable, on which an inserted gas bottle is put down. By rotating the turntable, the inserted gas bottle may be centered and/or aligned. By rotating the turntable, an information being stored on the inserted bottle may furthermore be supplied (moved) to a reading unit of the identification device for readout.

The filling device may comprise a movable filling head, which may be connected to the fitting of the inserted gas bottle for filling.

The emptying device may comprise a movable suction head, which may be connected to the fitting of the inserted gas bottle for emptying.

In one embodiment, the movable filling head and/or the movable suction head are elastically movable mounted, such as for example by an elastically flexible (stretchy) material like rubber, which is connected to an outer support. Hereby, the requirement concerning an accurate positioning of an inserted gas bottle is reduced. Usually, at this embodiment, comparatively technically extensive positioning components for an accurate positioning of a gas bottle in the filling station such as turntable may be omitted.

The filling device respectively filling station may comprise identification means like RFID writing and/or reading device, in order to allow identification of gas bottles or respectively to allow storing information concerning the gas bottle. The identification device may identify maintenance intervals or TÜV test intervals, and depending therefrom ask a user to return an emptied bottle at a return station.

The filling device may moreover have a transport device that, for a filling, transports a by the user inserted gas bottle in an automated way into the interior, respectively an interior room of the filling device that is not accessible from outside. A spatial distance between this interior area and the area, which may be accessible for a user, is thereby created. Hereby, the safety is further improved.

The filling station is preferably dimensioned and composed such that gas bottles may be filled, whose maximal permissible fill content lies between 5 kg and 35 kg gas. A gas bottle is usually for safety reasons permitted to be filled only up to 80% of the real maximally possible content.

Basically, there are sensors such as for example a proximity sensor for gas bottles. Having such a proximity sensor allows (early) timely recognizing that a gas bottle is or is to be inserted, in order to depending thereof control a refilling and the filling station. Such a proximity sensor allows alternatively or additionally recognizing an inserted bottle and for example monitored its height. There may be one ore more vibration sensors that allow for example detection of impermissible high vibrations of the filling station in order to for example trigger an alarm and thus for example protect against vandalism.

There may be one or more pressure sensors. Such pressure sensor allows for example to monitoring the gas pressure in a nitrogen filled container in order to signaling, depending therefrom, the demand for a refilling or exchanging of the container.

In a preferred embodiment, a refilling takes places as following.

A serial number is attached to each approved gas bottle, specifically in particular a serial number consisting of at least 6 digits (6 digit serial number). The serial number may usually be adhered well visible at a gas bottle or was stamped in the bottle surface. In one embodiment, a user enters this serial number into the filling station for legitimization and/or identification. The filling station checks the serial number and, in case of an approved serial number, enables the insertion into the filling station for a refilling. The refilling station recognizes the bottle type, the filling quality and weighs the bottle so that a difference between the known weight of the bottle and the measured weight can be determined by the filling station in order to determine the remaining quality of gas in the bottle.

Preferably, a proximity sensor is installed near the filling valves of an inserted gas bottle. It preferably recognizes, if the bottle is appropriately high and/or if the suitable filling valve is assembled and/or is suitably positioned.

Preferably, there is a control unit, which conducts the monitoring and control of the filling process and/or the monitoring and control of a preferably electronical payment process (e.g. by EC card, credit card or by mobile phone and the like). At the same time, the control unit monitors at least a gas sensor in order to detect untightness.

A release for filling is provided particularly only when one or more of the following steps have been conducted successfully by a control program:

an inserted bottle is identified the measured weight of the identified bottle is compared to stored data;

a minimum quantity is filled up to for example maximally 10% of the bottle volume in order to thereafter reliably conduct a gas leakage test; a gas sensor then checks possible untightness at the bottle;

a gas sensor checks, if sufficient nitrogen is available in one or more bottles or containers being provided for that, by which for example a pneumatic and thus riskless operation is enabled, specifically in particular for a pump of gas out of an inserted gas bottle;

a credit assessment is carried out.

If an untightness is detected, which is directly connected with the bottle, then in particular an automated bottle draining is carried out in order to emptying the bottle. The user then obtains preferably a printout with the advice to visit the next bottle dispensing point to exchanging the bottle. In addition, a telephone hotline number is preferably printed, which indicates for example the next bottle dispensing partner to the user.

In one embodiment, a pump is provided for a particularly riskless emptying of the bottle, which is driven by a controlled nitrogen supply during suction operation. The operation of an air compressor and a related risk of ignition in case of untightness are thereby advantageously avoided. The withdrawn and secured gas is for example supplied back into the gas tank. Alternatively, a small-scale storage may be used, which only serves the purpose to store withdrawn gas. In one embodiment, the withdrawn gas may be weighed by a weighing cell and be indicated on a or the already mentioned printout. For example, in one embodiment, a subsequent reimbursement of this gas quantity is carried out so that the user gets his gas back.

Inserted one or more nitrogen bottles or containers preferably comprise a pressure monitoring, which is preferably periodically retrieved by a control. Thereby, it allows monitoring the present quality of nitrogen and, if needed, refilling or respectively exchanging bottles or containers.

In one embodiment of the invention, the filling station comprises an exchange device for exchanging of a gas bottle. This exchange device is provided for the case that an inserted bottle may not be once again refilled due to a malfunction respectively a defect in particular due to a leakage issue. After the filling station has determined that an inserted gas bottle may not be once again refilled with gas and in particular also after the filling station has then emptied it by completely sucking off, the filling station enables an exchange of the defect gas bottle for a new gas bottle. By means of the exchange device, it is advantageously secured that a user may immediately take away a gas filled gas bottle, specifically completely independent of whether his afore brought along gas bottle could not be renewed refilled with gas due to a defect respectively a malfunction or not. Also, at this embodiment, the user does not have to transport the defect gas bottle to an appropriate repairing return point by himself. Advantageously, it can be waited until there is a plurality of defect gas bottles so that then either repairing of these bottles is carried out at the filling station or they are transported to a repairing station. In all, the transportation expenditure allows to be reduced compared to a single transport of defect gas bottles.

This new gas bottle is in one embodiment already immediately completely filled with gas. This embodiment is connected with the advantage that time is saved and the filling station may be very fast used for a further refilling. But it is also possible that by means of the exchange device only a fully functional empty gas bottle is provided, which firstly has to be filled with gas by the user of the gas station.

The exchange device comprises basically a control device, which enables an exchange and an access to a new gas bottle as soon as an inserted gas bottle proves to be defect and it in particular got drained. In a technical simple embodiment, the user removes it from a box, which is opened in a controlled manner, after an inserted gas bottle proves to be defect and in particular also after it was emptied by sucking. The user put the defect gas bottle in the box, which basically subsequently closes again. The box comprises preferably one or more identification means like proximity sensor, weighing machine or reading device for a barcode or a RFID chip in order to thereby detect the insertion of a defect gas bottle and to closing the box again when having inserted a defect gas bottle. In particular, the user or a head office being provided for this purpose by the operator, respectively, is informed online about the insertion of a defect gas bottle and thus also about the existing repair demand.

The exchange device comprises in particular a plurality of such boxes, specifically preferably at least four, particularly preferred at least eight. Alternatively, there bay be a transport device, which transports new gas bottles to an extraction opening or exchange opening as soon as an exchange is to be conducted. There may be a transport device, which transports an inserted gas bottle into the filling station after the filling station has detected a defect and in particular also after the filling station has emptied this gas bottle by sucking. At this embodiment, the user has not any more to remove the defect gas bottle. Instead, the user receives the information for example though a display and/or though loudspeaker that he may take a new gas bottle from the exchange device.

The exchange device comprises in particular an information device, which informs the user optically (visually) and/or acoustically that a defect was detected and which informs the user how he obtains a new gas bottle though the exchange device.

A bottle filling (gas bottle) is basically occurs out of a gas tank provided for that. The gas usually consists of at least 95% propane. The gas is conveyed in the desired manner for example though a submersible pump, which is installed in the gas tank, or a side channel pump, which may be arranged outside of the gas tank. A suction operation is possible or alternative a natural supply through a sampling pipe, which is then arranged advantageously below the gas tank.

In one embodiment, the filling station is equipped with a mobile communication transmission module like for example GSM module in order to facilitate a mobile set up. At this embodiment, for example data for an electronic payment and/or data concerning the state of the filling station are transmitted wireless to a receiving station provided for that.

Power cuts may in one embodiment be bridged though a provided battery buffer so that the station state, transactions as well as for example an emergency phone remain further on operative (keep functioning).

In one embodiment, lighting is installed in the working area.

An interior room may in one embodiment be accessible via a fire door.

Figure 2:
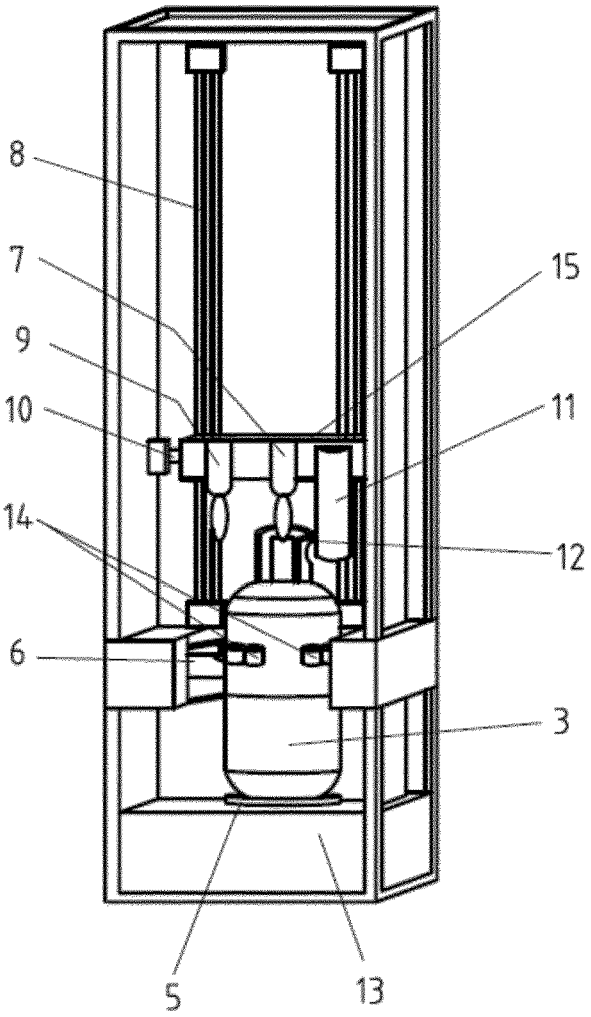
Figure 3:
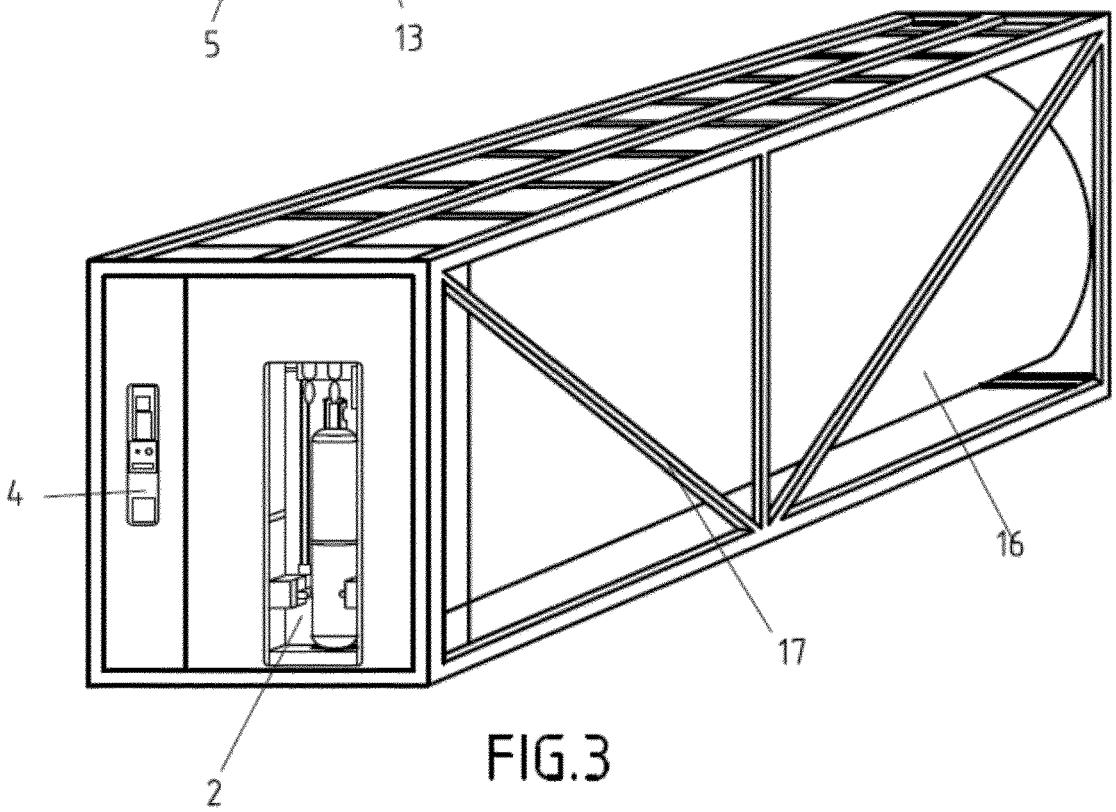
Figure 4:
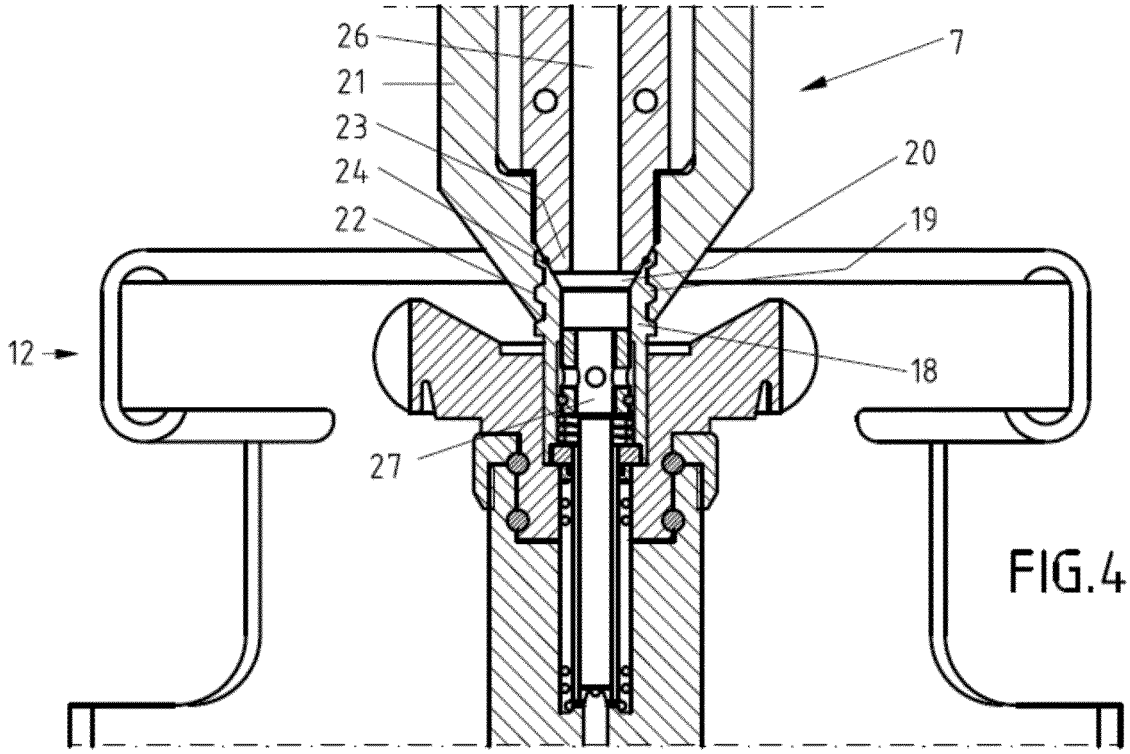
Figure 5:
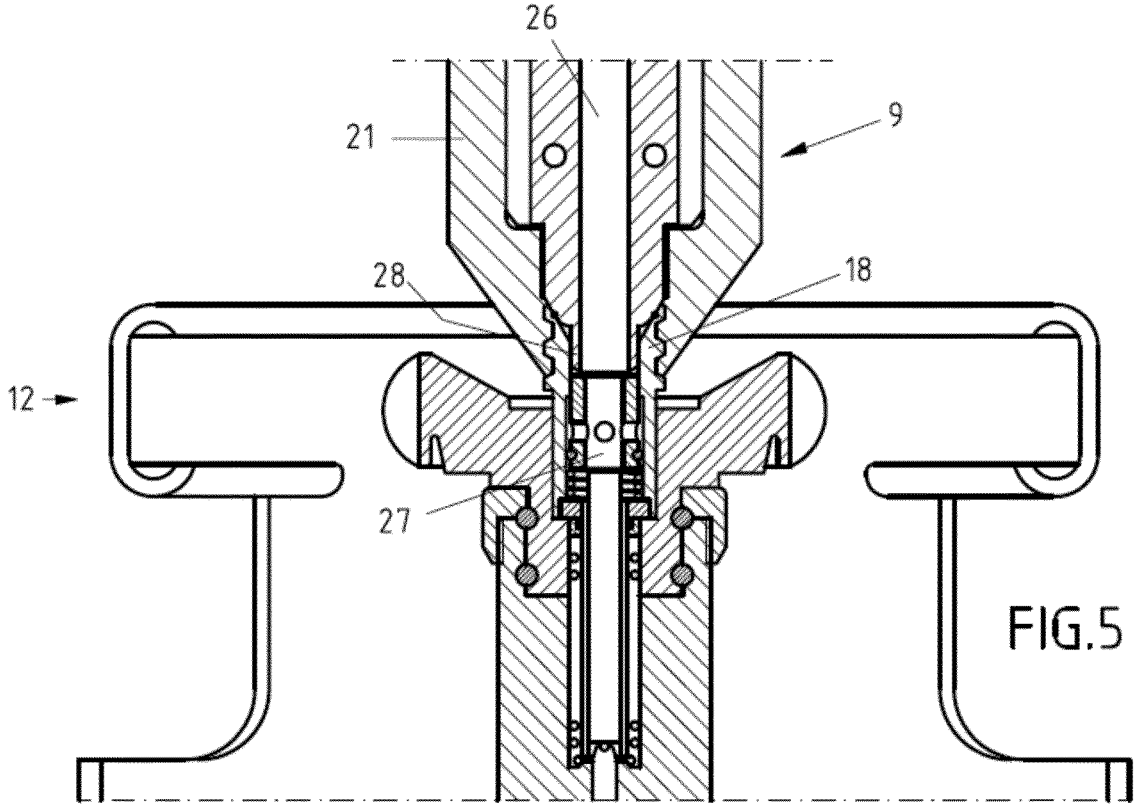
Figure 6:
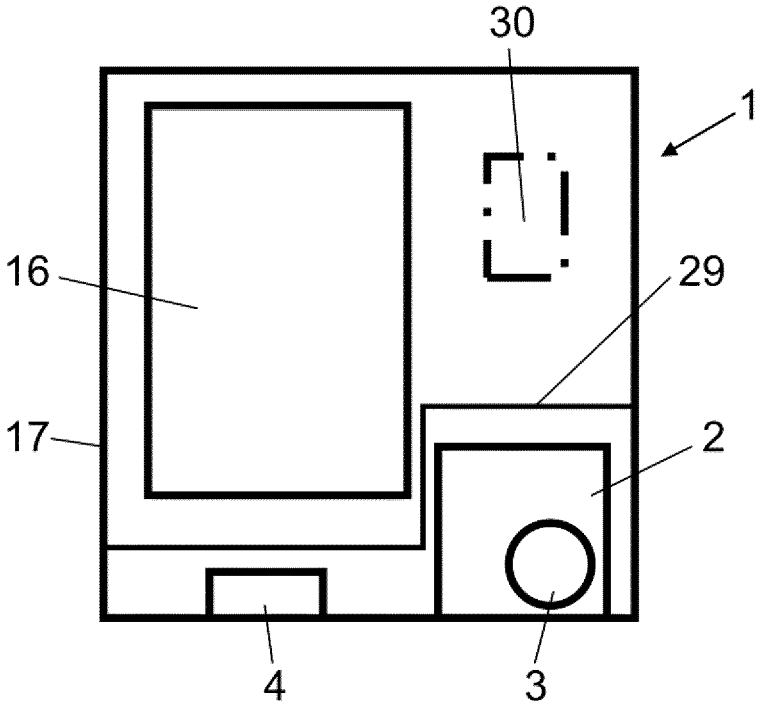
Figure 7:
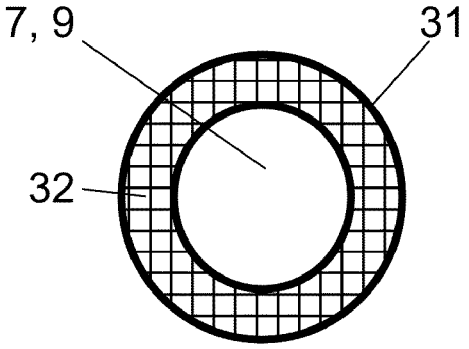

In the following, the invention is described in detail based on figures:

It shows:

FIG. 1: Filling station with payment machine;

FIG. 2: Interior room of a filling station;

FIG. 3: filling station with tank;

FIG. 4: filling head with centric filling point of a gas bottle;

FIG. 5: suction head with centric filling point of a gas bottle;

FIG. 6: drawing of an arrangement of a filling station with tank seen from top;

FIG. 7: elastically mounted suction head or filling head.

The FIG. 1 shows a filling station 1 with an interior room 2, in which a gas bottle 3 is inserted. It is shown a gas bottle 3 with a maximal permissible filling quality of 35 kg. The interior room 2 can be completely closed, specifically preferably gas tight, by a not shown door, for example a sliding door. The filling station comprises a payment device 4 to allow immediate payment for a refilling. Alternatively or additionally, the device 4 serves operating the filling station. In the interior room 2, there is a turntable 5, on which the gas bottle 3 is put down. There is a centering device with grip arms 6, by which the gas bottle 3 can be centered. In the interior room 2, there is a movable filling head 7, though which the gas bottle 3 can be filled with gas. By means of a moving device (traversing unit) comprising two vertical running rails 8, the filling head 7 can be moved vertically, in order to connect the filling head 7 to the gas bottle 3 for a filling by vertical movement. Next to the filling head 7, there is a movable suction head 9, though which the gas bottle 3 can be emptied. There is a horizontally running rail 10 for a horizontal movement (traveling) of the filling head 7 and the suction head 9. Furthermore, there is a movable leakage test head 11 of a gas testing device in the interior room 2 which allows to test if the gas bottle is gas tight. The leakage test head 11 may also be moved along the mentioned rail 8 and 10 both horizontally as well as also vertically.

In the case of FIG. 1, the filling head 7 is connected to the gas bottle 3 for filling. The gas bottle 3 comprises a fitting with a centric filling point 12 to allow filling and emptying the gas bottle 3 from above.

The option of movement (travel) serves to enable, if needed, suitably connecting the filling head 7, the suction head 9 as well as the leakage test head 11 to the fitting of the gas bottle 3. The movement of filling head 7, the suction head 9 as well as the leakage test head 11 is carried out in an automated manner by a not shown motorized drive as well as a not shown control apparatus.

The turntable 5 is arranged on a weighing machine 13 to allow determining the weight of an inserted gas bottle 3.

In the leakage test head, there is a gas sensor. When the test head 11 is put according to specified normal operation on the gas bottle 3 from above, then an interior room is provided by the test head, in which the fitting of the gas bottle with the centric filling point 12 is placed. Thereby, it can be particularly fast and reliably determined by the gas sensor if the fitting or the connection between the fitting and the gas bottle 3 is untight.

The FIG. 2 shows the interior room 2 in an enlarged view. Here, in contrast to FIG. 1, a gas bottle 3 with concentric filling point 12 is shown, whose maximal permissible filling quality is 5 kg. Again, the filling head 7 is connected with the centric filling point 12 to the gas bottle 3 for a filling. Compared to FIG. 1, the horizontal running rail 10 has been moved downwards for that purpose to thereby connect the filling head 7 to the centric filling point 12 for a filling. It is also shown that the filling station 1 is suitable for differently sized gas bottles, specifically in particular for gas bottles whose maximal permissible filling quantity lies between 5 kg and 35 kg.

The FIG. 2 shows that the arm 6 of the centering gripper of the centering device is provided with rolls 14, which facilitate a positioning and holding of the bottle by embracing. A rotation of the turntable 5 also contributes to a positioning of the gas bottle 3.

The FIG. 2 illustrates that the filling head 7, suction head 9 and test head 11 are mounted together on a slide 15, which allows to be moved along the rail 10 horizontally.

The FIG. 3 illustrates that the filling station may be provided with an integrated gas tank 16. The gas tank 16 may be arranged together with the filling station inside of a frame and/or housing 17 to thereby provide a transportable unit. The transportable unit is particularly dimensioned such that it may be transported by common trucks. The unit may be part of a truck such as for example part of a semi-trailer truck of a truck.

The FIG. 4 shows a section of a filling head 7, which is connected to a centric filling point 12 of a gas bottle. The centric filling point 12 has an upwards protruding nozzle 18, which comprises projections 19 at the outer face. The upwards oriented end of the nozzle 18 is formed as funnel 20.

The filling head 7 has two movable grip elements 21 with inside circumferential grooves 22. The grip elements 21 can be closed by folding such that a positive connection (form-fit) is created between the circumferential projections 19 and the circumferential grooves 22. A conical end 23 of the filling head 7 is then arranged in funnel 20 and is pressed against a sealing ring 24 being located in the funnel 20, which may be hold by a notch. Though a tubular line 26, the under pressure liquefied gas may then be pumped into the gas bottle. The pumping pressure effects that a corresponding valve body 27 at the centric filling point 12 is moved against a spring force and the valve is thus opened.

The suction head 9 shown in the FIG. 5 differs from the filling head shown in the FIG. 4 by an extended tubular end 28. When the suction head 9 is connected to the centric filling point 12 as shown in the FIG. 5, the tubular end 27 reaches such far into the nozzle 18 that the valve body 27 is hereby pressed downwards against a spring force and thus the valve is opened, in order to enable sucking off and thus an emptying of the gas bottle. Due to the tubular shape, sucking of the gas may be carried out though the extended end so that this nozzle-shaped end 27 may advantageously fulfill a double function.

The FIG. 6 draws a top view on a particular suitable arrangement of the components of a filling station 1. Inside of the frame and/or housing 17, there is the gas tank 16 behind the operating and/or payment device 4. The interior room 2 or a portion thereof, respectively, is arranged at the side next to a face side of the gas tank 16 and the operating and/or payment device 4. In one preferred embodiment for the purpose of increasing the operational safety, a from top seen stair-shaped separation wall 29 separates the area with the gas tank 16 from the area, in which the operating and/or payment device 4 as well as the interior room 2 are arranged. Next to the gas tank 16, there remains a free room (space), in which further equipment being suitable for operating the filling station 1 as well as components 30 like control installations, lines etc. are arranged. The arrangement shown in the FIG. 6 avoids an elongated base area and is thus particular suitable for setting up in retail shops, on camping grounds as well as service stations. The filling station thus has in particular a size of a 10-foot container.

In the free room, there are for example provided one or more containers for nitrogen in order to, in the case of gas untightness, thereby provide nitrogen for a pneumatic drive, by which the gas may be pumped out of the untight gas bottles. The installations and components 30 may be an exchange device, a spare container for pumped off gas and/or one or more pumps. A control installation (unit/apparatus/device) as well as an emergency power supply may be provided as installation 30. The area with the installations and components 30 may in particular be accessed though a fire door in order to for example exchange nitrogen container if needed or remove defect gas bottles stored here.

The FIG. 7 draws an elastic mounting of a filling head 7 or of a suction head 9, respectively. The filling respectively suction head 7, 9 is connected to an outer support 31 through elastic material like rubber 32 and thus allows to be elastically moved relatively to the outer support.

The invention claimed is:

1. A filling station for an automated refilling of a gas bottle by an end-user comprising an insertion device for inserting of an emptied gas bottle into the filling station, a closing device for closing the filling station after the insertion of the gas bottle such that a removal of the gas bottle is not possible while the filling station is closed, a filling device for an automated filling, after said closing, of a gas bottle that has been inserted into the filling station, a gas testing device for an automated gas leakage test subsequent to a refilling of an inserted gas bottle, a release device that releases a refilled gas bottle upon a successful gas leakage test and thereby enables a removal of a refilled gas bottle, and a suction head by which a valve of the inserted gas bottle can be opened by connecting with a fitting of the inserted gas bottle and through which the content of the inserted gas bottle can be sucked off.

2. The filling station of claim 1, comprising an identification device, by which a gas bottle can be identified.

3. The filling station of claim 2, wherein the filling station is configured such that an insertion of a gas bottle into the filling station is only possible, when the filling station has previously determined by means of identification that the gas bottle is suitable for a refilling.

4. The filling station of claim 1, wherein there is a weighing machine, by which the weight of an inserted gas bottle can be determined before the refilling and/or after the refilling.

5. The filling station of claim 1, wherein the suction head has a protruding nozzle or a protruding pin, by which the valve can be opened by means of the connecting.

6. The filling station of claim 1, wherein there is a filling head by which an inserted gas bottle can be filled with gas.

7. The filling station of claim 1, wherein a filling head, the suction head and/or a leakage test head are mounted together on a movable slide.

8. The filling station of claim 1, wherein there is a centering device, by which the position of an inserted gas bottle can be centered.

9. The filling station of claim 8, wherein the centering device comprises a turntable and/or one or more centering grip arms.

10. The filling station of claim 9, wherein the one or more grip arms are provided with one or more rolls, which allow lying against an inserted gas bottle.

11. The filling station of claim 1, wherein the filling station is configured such that refilling of an inserted gas bottle is carried out from above via a centric filling point of the gas bottle.

12. The filling station of claim 1, wherein the filling station comprises a payment device.

13. The filling station of claim 1, wherein the filling station is set up at a camping ground or a service station.

14. The filling station of claim 1, wherein a filling head and/or the suction head are elastically movably mounted.

15. The filling station of claim 1 with a gas tank, which is arranged, seen from top, behind an operating and/or payment device.

16. The filling station of claim 1 with a gas tank, wherein an interior room that is provided for putting down a gas bottle is arranged, seen from top, at least partial next to a face side of a gas tank.

17. The filling station of claim 1 with one or more containers filled with nitrogen, and the suction device is drivable by the nitrogen for sucking off gas from an inserted gas bottle.

18. The filling station of claim 1 with a control unit, which controls a refilling in such a way that firstly a first quantity of gas is filled into an inserted gas bottle, thereafter a gas leakage test is carried out, and the bottle is fully refilled after it was determined by means of the gas leakage test that the gas bottle is gas tight.

19. The filling station of claim 1 with an exchange device, which provides a new gas bottle, after the filling station has determined a defect of an inserted gas bottle.

20. A method for refilling a gas bottle in a filling station with the features of claim 1 comprising the steps:

inserting an emptied gas bottle having a centric filling point into the filling station, centering the gas bottle by means of a centering device, using the filling device to fill, in an automated manner, the centered gas bottle with gas, after the filling, testing for leaking of gas from the gas bottle by means of the gas testing device in an automated manner, if the test reveals that no gas escapes from the gas bottle, allowing removal of the refilled gas bottle from the filling station, and if the test reveals that gas escapes from the gas bottle, using the suction head to open a valve of the gas bottle and suck off the content of the gas bottle for allowing removal of the emptied gas bottle from the filling station.

21. A filling station for an automated refilling of a gas bottle by an end-user comprising an insertion device for inserting of an emptied gas bottle into the filling station, a closing device for closing the filling station after the insertion of the gas bottle such that a removal of the gas bottle is not possible while the filling station is closed, a filling device for an automated filling, after said closing, of a gas bottle that has been inserted into the filling station, a gas testing device for an automated gas leakage test subsequent to a refilling of an inserted gas bottle, a release device that releases a refilled gas bottle upon a successful gas leakage test and thereby enables a removal of a refilled gas bottle, and an emptying device, by which the content of an inserted gas bottle can be sucked off, wherein the emptying device is configured to empty an inserted gas bottle if a gas leakage test reveals that the filled gas bottle is not tight.

* * * * *